US007216949B2

(12) United States Patent
Hasebe et al.

(10) Patent No.: US 7,216,949 B2
(45) Date of Patent: May 15, 2007

(54) INK JET PRINTER

(75) Inventors: Takashi Hasebe, Hachioji (JP); Saburo Shimizu, Hachioji (JP); Tetsu Sekine, Hachioji (JP); Shuta Hamada, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 335 days.

(21) Appl. No.: 11/006,667

(22) Filed: Dec. 8, 2004

(65) Prior Publication Data

US 2005/0231542 A1 Oct. 20, 2005

(30) Foreign Application Priority Data

Apr. 14, 2004 (JP) ..... 2004-119017
Oct. 28, 2004 (JP) ..... 2004-313732

(51) Int. Cl.
*B41J 29/38* (2006.01)

(52) U.S. Cl. ..... 347/14

(58) Field of Classification Search ..... 347/9, 347/10, 14, 19, 11, 29, 6, 23, 81
See application file for complete search history.

(56) References Cited

U.S. PATENT DOCUMENTS 4,835,435 A * 5/1989 Yeung et al. ..... 310/324
6,527,358 B2 3/2003 Kuriyama et al.

FOREIGN PATENT DOCUMENTS

JP 02239943 A * 9/1990

* cited by examiner

*Primary Examiner*—Stephen Meier
*Assistant Examiner*—Lisa M. Solomon
(74) *Attorney, Agent, or Firm*—Finnegan, Henderson, Farabow, Garrett & Dunner, L.L.P.

(57) ABSTRACT

An ink jet printer has: a vibration detection section to receive ink jetted from the nozzles and output a detection signal having an amplitude corresponding to a vibration generated when the ink lands; a sampling section to sample an amplitude value of the detection signal by a predetermined sampling clock signal; a storing section to store an amplitude value data of the detection signal sampled by the sampling section; a judging section to judge a jet failure of the nozzles based on the amplitude value data of the detection signal in the storing section; and a control section to control to jet the ink continuously a plurality of times with a jet drive cycle which is set by multiplying a standard drive waveform time of an ink jet signal from the nozzles by an odd number not less than five when detecting a jet failure of the nozzles.

17 Claims, 14 Drawing Sheets

FIG.6

141

| ADDRESS | | | DATA |
|---|---|---|---|
| A1 | | A2 | |
| 01 | x | 0000 | |
| 01 | x | 0001 | DETECTED DATA IN CLK1 |
| 01 | x | 0002 | DETECTED DATA IN CLK2 |
| 01 | x | 0003 | DETECTED DATA IN CLK3 |
| ⋮ | | | ⋮ |
| 02 | x | 0000 | |
| 02 | x | 0001 | DETECTED DATA IN CLK1 |
| 02 | x | 0002 | DETECTED DATA IN CLK2 |
| 02 | x | 0003 | DETECTED DATA IN CLK3 |
| ⋮ | | | ⋮ |

JET DRIVE SIGNAL Sm0
INK JET SIGNAL Sm1
SAMPLING START SIGNAL Ss
PIEZO VIBRATION SIGNAL Sd
Tm0
AL
Td
Ts
t1
t2

SAMPLING START SIGNAL Ss
SAMPLING CLOCK SIGNAL Sc
PIEZO VIBRATION SIGNAL Sd
Ts
CLK2
CLK1
CLKm

INK JET PRINTER

BACKGROUND OF THE INVENTION

1. Field of the Invention

The present invention relates to a detection of a jet failure of a nozzle in an ink jet printer.

2. Description of the Related Art

In an earlier developed ink jet printer, an image is recorded by jetting ink droplets onto a recording medium from a plurality of nozzles which use a thermal system or a piezo system actuated according to jet signals based on image signals. In the ink jet printer, fixing of ink near nozzles due to drying or increased viscosity of the ink in a case of being left for a long period of time without being used or adhering of impurities (foreign particles) or the like to the nozzles would cause clogging of the nozzles, which results in a failure of jetting ink droplets from the nozzles in spite of normally outputting ink jet signals from a drive circuit, that is, a jet failure of ink from the nozzles (hereinafter, referred to as nozzle clogging). The nozzle clogging would cause a deterioration of print quality such as generating a blank in a printed character or image, which is recognized as a white stripe, or causing difference of reproduced color in each recorded image due to a lack of ink color material. Therefore, an optical detection section as a detection section for detecting such the nozzle clogging has been disclosed.

For example, disclosed is an ink jetting condition detection method for detecting nozzle clogging by changing a detection timing with a photo sensor in which light emitting elements and light receiving elements are combined along a distance corresponding to the width of the head as a detection section of nozzle clogging of a carriage type ink jet printer in which ink is jetted from the head in a direction (main scanning direction) perpendicularly crossing a carrying direction of a paper (sub scanning direction) to form an image (JP-Tokukai-hei-11-188853A, hereinafter referred to as "Patent Document 1").

However, applying Patent Document 1 to a line head type ink jet printer could be causative factors of cost increase due to the needs to adjust the amount of light or the diameter of beam from the light emitting elements with high accuracy because one line head has a large length and the size of the ink droplets jetted from the nozzles is small, and to move the detection section for nozzle clogging by using a positioning sensor with high accuracy. Also, the distance between the light emitting elements and the light receiving elements becomes large, which may cause misdetection due to dust or ink droplets in the form of mist. Further, since a large number of nozzles which need to be detected exist in one line head, it would raise a problem that time for detection becomes long.

SUMMARY OF THE INVENTION

The present invention is developed in view of the above described problems, and an object of the present invention is to provide an ink jet printer capable of precisely detecting nozzle clogging by utilizing impact force generated when an ink droplet jetted from a nozzle lands.

For solving the problems, in accordance with a first aspect of the present invention, the ink jet printer to record an image on a recording medium by jetting ink from nozzles comprises:

a vibration detection section to receive ink jetted from the nozzles and output a detection signal having an amplitude corresponding to a vibration generated when the ink lands on the vibration detection section;

a sampling section to sample an amplitude value of the detection signal by a predetermined sampling clock signal;

a storing section to store an amplitude value data of the detection signal sampled by the sampling section;

a judging section to judge a jet failure of one of the nozzles based on the amplitude value data of the detection signal stored in the storing section; and a control section to control to jet the ink continuously a plurality of times with a jet drive cycle which is set by multiplying a standard drive waveform time of an ink jet signal from the nozzles by an odd number which is not less than five when detecting a jet failure of one of the nozzles.

In accordance with a second aspect of the present invention, the ink jet printer to record an image on a recording medium by jetting ink from nozzles comprises:

a vibration detection section to receive ink jetted from the nozzles and output a detection signal having an amplitude corresponding to a vibration generated when the ink lands on the vibration detection section;

a sampling section to sample an amplitude value of the detection signal by a predetermined sampling clock signal;

a storing section to store an amplitude value data of the detection signal sampled by the sampling section;

a judging section to judge a jet failure of one of the nozzles based on the amplitude value data of the detection signal stored in the storing section; and a control section to control to jet the ink continuously n times with a predetermined jet drive cycle from the nozzles when detecting a jet failure of one of the nozzles, wherein the judging section judges the jet failure of one of the nozzles based on only a control for jetting the ink from n/2 times in a control for jetting the ink continuously n times, and the n is an integer which is not less than two.

BRIEF DESCRIPTION OF THE DRAWINGS

The present invention will become more fully understood from the detailed description given hereinafter and the accompanying drawings which are given by way of illustration only, and thus are not intended as a definition of the limits of the present invention, and wherein;

FIG. 6 is an example of a memory map 141 stored in a storing unit 140;

DETAILED DESCRIPTION OF THE PREFERRED EMBODIMENTS

[First Embodiment]

Figure 1:
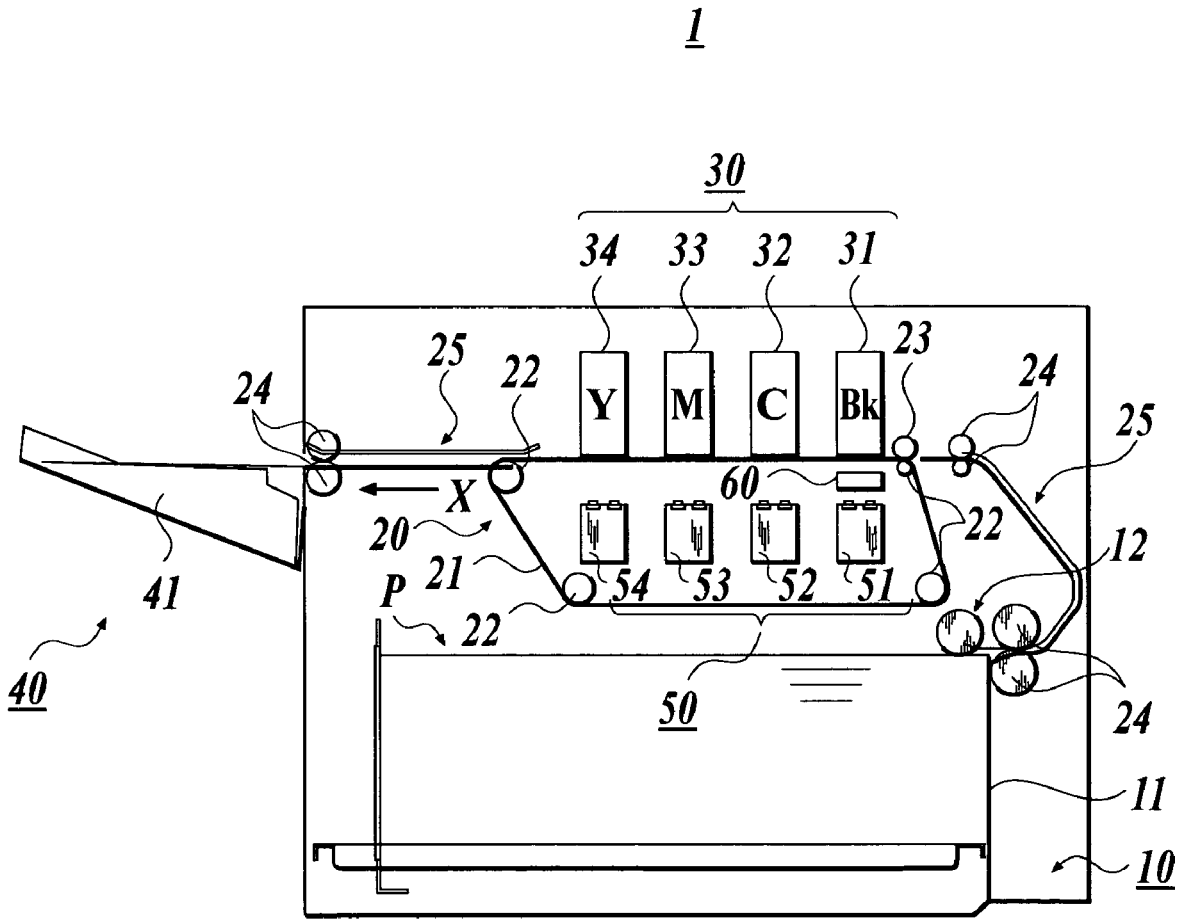
FIG. 1 is a schematic view of an inside of an ink jet printer 1 in the first embodiment in which the present invention is applied.

The first embodiment of the present invention will be explained below referring to the drawings.

The configuration will be explained first.

FIG. 1 shows a schematic view of the inside of an ink jet printer 1 of a line head type in the first embodiment. As shown in FIG. 1, the ink jet printer 1 comprises a paper feed part 10, a carrying part 20, a head unit part 30, a paper discharge part 40, a maintenance part 50 as a maintenance section, a nozzle clogging detection part 60 and the like.

The paper feed part 10 is provided with a paper feed tray 11 for stacking and storing a plurality of recording mediums P at the lower side of the inside of the ink jet printer 1. A paper pick up device 12 is provided at one end portion of an upper side of the paper feed tray 11 for picking up the recording medium P on which an image is to be recorded one by one from the paper feed tray 11.

The recording medium P to be applied includes various types of papers such as a plain paper, a recycled paper, a gloss paper or the like, and a cut sheet shaped recording medium made from a material such as various types of textiles, non-woven fabrics, resin, metal, glass or the like.

The carrying part 20 for carrying the recording medium P is provided on the upper side of the paper feed part 10. The carrying part 20 comprises a carrying belt 21, tension rollers 22, a pressure roller 23, carrying rollers 24 and a carrying path 25.

The carrying belt 21 is a circular shaped belt for carrying the recording medium P in a horizontal direction while supporting it in a plane state, and is movably tensioned by the plurality of tension rollers 22. The carrying belt 21 is provided with an opening parts 21*a*, so that a nozzle clogging detection part 60 to be described later is movable and a capping module covers nozzles. An encoder film and an encoder sensor are provided at the end portion of the carrying belt 21 to make the opening part 21*a* be positioned at the lower side of the nozzles when judging nozzle clogging or performing a maintenance operation, thus the position of the opening part 21*a* can be detected based on the detection signal from the encoder sensor (not shown).

The pressure roller 23 is rotatably provided at a portion where the carrying belt 21 and the recording medium P start to contact with each other as a roller to put pressure onto the carrying belt 21 for carrying the recording medium P in a flat shape.

The carrying path 25 is a path for carrying the recording medium P which was fed from the paper feed tray 11, and for discharging the recording medium P carried along the periphery of the carrying belt 21 to a paper discharge part 40. The carrying rollers 24 are provided at a predetermined position of the carrying path 25 as a plurality pairs of rollers for carrying the recording medium P in a carrying direction X.

A head unit part 30 comprises line head type head units 31, 32, 33, 34 at the portion near the upper portion of the carrying belt 21, for jetting each ink color of black (Bk), cyan (C), magenta (M) and yellow (Y) onto the recording medium P in this order along the carrying direction X, each of which comprises a plurality of nozzles (not shown) and extends along the whole width of the carrying belt 21. Each head unit 31, 32, 33, 34 is disposed to make the nozzle-plates thereof face the periphery of the carrying belt 21.

The recording medium P on which an image was formed by ink droplets jetted from each head unit 31, 32, 33, 34 is discharged from the paper discharge part 40 in order.

Each head unit 31, 32, 33, 34 extending in a direction approximately perpendicular to the carrying direction X of the recording medium P comprises a plurality of head modules as an ink jet section arranged in parallel in a longitudinal direction. Each head module extends in the longitudinal direction of each head module 31, 32, 33, 34, and they are alternately arranged in parallel with each other at predetermined intervals in the carrying direction X of the recording medium P (staggered arrangement).

The paper discharge part 40 comprises a paper discharge tray 41 provided at the side portion of the ink jet printer 1, and the recording medium P on which an image was formed is discharged therefrom in order.

The maintenance part 50 is provided at the lower side of the head unit 30 to face thereto across a portion near the lower portion of the upper surface of the carrying belt 21. The maintenance part 50 comprises a plurality of cap units 51, 52, 53, 54 for covering the nozzles, a suction pump which is not shown, and a waste ink tank.

Each cap unit 51, 52, 53, 54 comprise a plurality of capping modules (not shown) each of which corresponds to each head module of each head unit 31, 32, 33, 34. Each capping module is movable between a capping position for capping the nozzles of each head module corresponding thereto and a separated position where each capping module is separated from the nozzles. Coupled to each capping module is a suction pump and an air communicating valve or the like for suctioning fluid in a space which is formed after each capping module is moved to the capping position and the whole nozzles are covered by a rubber member or the like to shut off the outside air and be sealed. That is, the air and the ink inside the space are suctioned by the suction pump. The ink suctioned by the suction pump is discharged to the waste ink tank. The configurations of the suction pump, the air communicating valve, the waste ink tank and the like are same as those of the earlier technique, therefore the detailed descriptions thereof are omitted here.

In the first embodiment, explanation will be made to an example in which a suction operation which is a representative of a maintenance method is adopted as a method to solve nozzle clogging. However, a flashing operation may be adopted, in which electrical signals are given to the heads to jet ink droplets, and foreign materials or the like adhered to the nozzles and the nozzle-plates are flashed.

Further, a mechanism for performing a wiping operation to wipe unnecessary ink droplets adhered to the nozzle-plates after the suction operation or the flashing operation may be provided.

The nozzle clogging detection part 60 is provided at the lower portion of the head unit part 30 to face thereto across the portion near the lower portion of the upper surface of the carrying belt 21, and is movable to the predetermined position corresponding to each head unit 31, 32, 33, 34. A plurality of nozzle clogging detection parts 60 extend in the longitudinal direction of the head unit and are alternately arranged in parallel with each other at predetermined intervals in the carrying direction X of the recording medium P, to correspond to each head module.

Figure 2B:
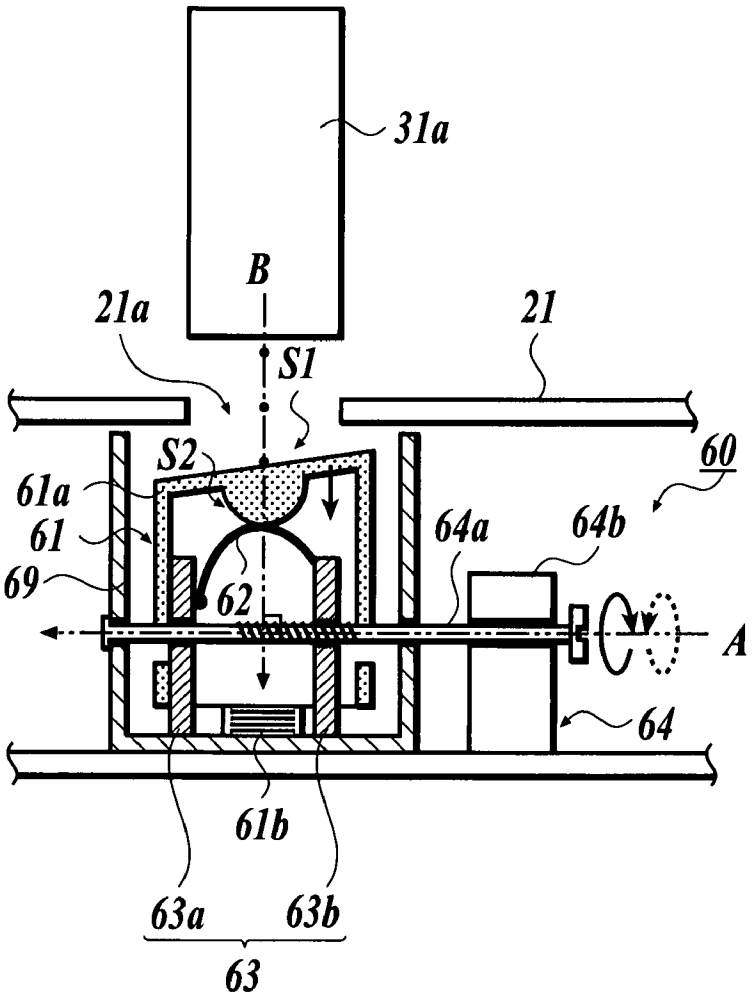
FIG. 2B is a view showing a state where the nozzle clogging detection part has received an ink droplet from the head module 31*a* (operating state)
Figure 2A:
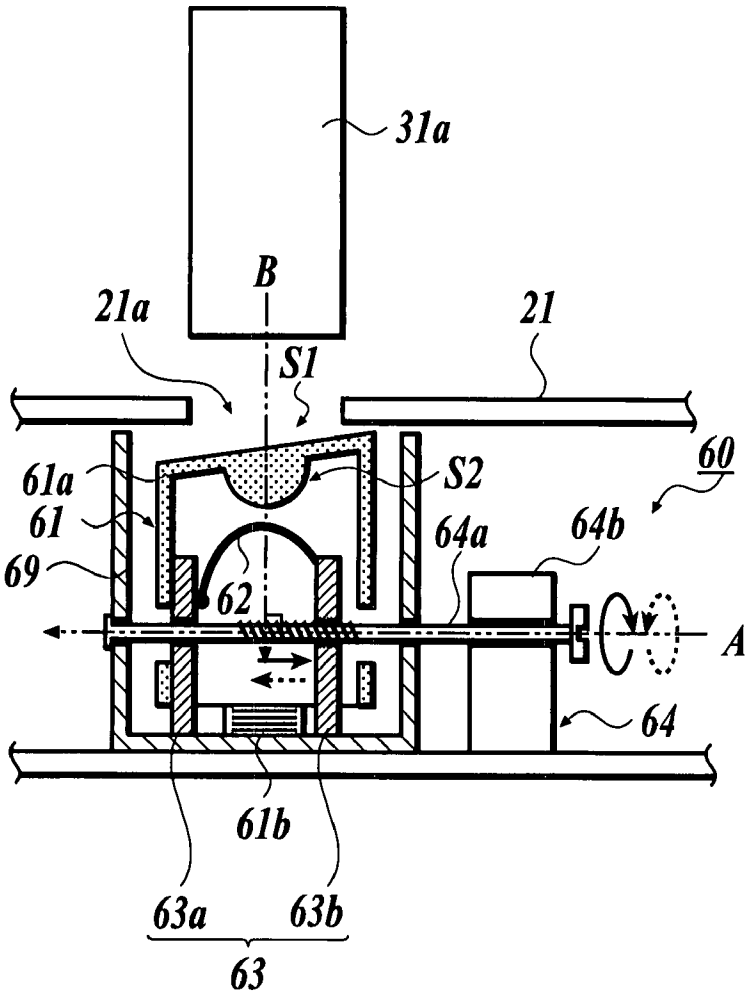
FIG. 2A is a view showing a state where a nozzle clogging detection part has not received an ink droplet from a head module 31*a* (initial state)

FIGS. 2A and 2B show end views of the nozzle clogging detection part 60.

FIG. 2A shows a state where the nozzle clogging detection part 60 has not received an ink droplet from the head module 31*a* (initial state), and FIG. 2B shows a state where the nozzle clogging detection part 60 has received an ink droplet from the head module 31*a* (operating state).

As shown in FIGS. 2A and 2B, the nozzle clogging detection part 60 comprises an ink droplet receiving part 61, a piezo film 62 as a vibration detection portion, a supporting part 63, an adjusting part 64 and the like.

In the first embodiment, the explanation will be made in the case where the piezo film of a film shaped piezoelectric elements is used as a vibration detection portion, however, it is not limited thereto as long as the vibration detection portion is capable of receiving ink droplets jetted from the nozzles and outputting mechanical displacement (vibration) as electric charge (amplitude) when the ink droplets land, thus, it may be a strain gage or the like.

The ink droplet receiving part 61 comprises a cover 61*a* and an elastic supporting member 61*b*, and transmits the impact force generated when ink droplets land to the piezo film 62.

The cover 61*a* comprises an ink droplet landing surface S1 for receiving ink droplets and a contact surface S2 for transmitting the impact force by contacting with the piezo film 62 when ink droplets land on the ink droplet landing surface S1. The contact surface S2 is provided with a projecting portion at a position to face the maximum projecting portion of the curved outer periphery of the piezo film 62 for transmitting the impact force generated when ink droplets land to the maximum projecting portion.

The cover 61*a* extends in the longitudinal direction of the head module corresponding thereto to be interposed between the nozzles and the piezo film 62, so that the piezo film 62 can be protected from various ink droplets. Thus, the response property of the piezo film 62 can be protected.

There is an ink jet printer in which a property (viscosity) of the ink to be jetted changes depending upon the ink used. Specifically, there is a case where the ink is heated to the temperature higher than room temperature to lower the ink viscosity, and the ink droplets with high temperature are detected. In such ink jetting method, the temperature of the piezo film rises after receiving tens of ink droplets, which would cause a change to the response property of the piezo film. Thus, the cover 611*a* has a purpose to prevent such the change of the response property. When the ink to be used is electrically conductive ink, the cover 611*a* can prevent the piezo film from being damaged when the electrically conductive ink contacts the output signal terminals of the piezo film.

The cover 61*a* is kept in stationary state with a certain state by the elastic supporting member 61*b* provided on the bottom portion, and transmits small impact force generated when the ink droplets land onto the piezo film 62, so that it is preferable to use workpiece materials which are light in weight such as plastic or the like and can be formed to be an arbitrary shape.

The elastic supporting member 61*b* supports the cover 61*a* to keep the contact surface S2 of the cover 61*a* and the piezo film 62 in a non-contact state when the ink droplet landing surface S1 does not receive ink droplets, and to make the contact surface S2 of the cover 61*a* be in the contact state with the piezo film 62 when the ink droplet landing surface S1 receives ink droplets.

In the first embodiment, when the ink droplet landing surface S1 does not receive ink droplets, the contact surface S2 and the piezo film 62 are set to be in the non-contact state, however, both of them may contact with each other, that is, the present invention is not limited to this embodiment as long as the piezo film 62 and the contact surface S2 are in a stationary state while keeping a certain equilibrium state.

The piezo film 62 is curved into an approximately half cylinder ahead in the ink droplet jetting direction from the nozzles by the support part 63, and is supported to make the maximum projecting portion of the curved outer periphery direct to an ink droplet coming direction. The piezo film 62 extends corresponding to the longitudinal direction of the head module.

In the first embodiment, the landing of ink droplets is detected by using piezoelectric effect of the piezo film 62. To further improve sensitivity and directivity of the piezo film 62, the piezo film 62 is curved into an approximately half cylinder, and ink droplets from the ink droplet coming direction land onto the maximum projecting portion of the curved outer periphery (that is, the maximum projecting portion of the piezo film 62 which is curved into an approximately half cylinder contacts with the projecting portion of the contact surface S2 of the cover 61*a*).

The piezo film 62 used in the invention may be any piezoelectric element as long as the piezoelectric element is formed in a film shape, which is easy to thin even when it has a large size, with piezoelectric effect and improved productivity, having excellent flexibility, impact-resistance, chemical stability or the like in comparison with an earlier developed piezoelectric ceramic or the like, and has a better output response to impact or shape changing, wide frequency characteristic or the like.

Figure 3A:
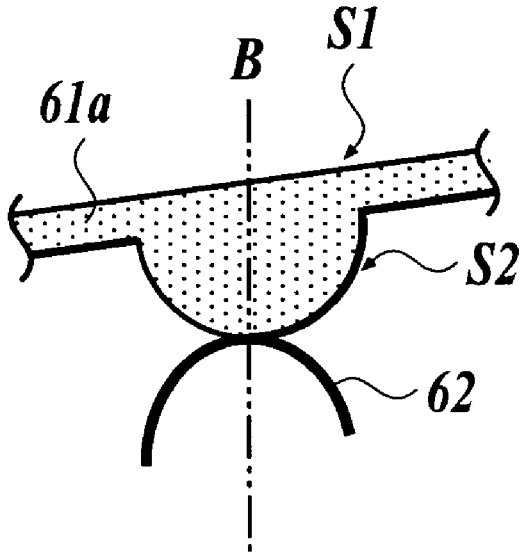
FIG. 3A is a view in which a maximum projecting portion of a contact surface S2 of the cover 61*a* contacts with a maximum projecting portion of a piezo film 62.
Figure 3B:
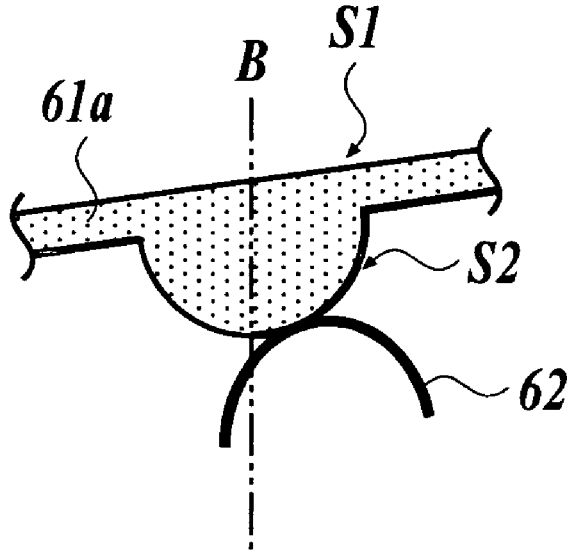
FIG. 3B is a view in which the contact surface S2 of the cover 61*a* contacts with the piezo film 62.

FIGS. 3A and 3B show sectional views of examples of a contact state of the contact surface S2 of the cover 61*a* and the piezo film 62. FIG. 3A shows a state that the maximum projecting portion of the contact surface S2 of the cover 61*a* contacts with the maximum projecting portion of the piezo film 62, and FIG. 3B shows a state that the contact surface S2 of the cover 61*a* contacts with the piezo film 62.

As shown in FIG. 3A, in the case where the maximum projecting portion of the cover 61*a* contacts with the maximum projecting portion of the curved outer periphery of the piezo film 62, when ink droplets from the nozzles land on the ink droplet landing surface S1, a small impact force generated by the landing of the ink droplets onto the ink droplet landing surface S1 can be concentrated on the maximum projecting portion of the contact surface S2, thereby enabling the maximum projecting portion of the piezo film 62 to receive the impact force. Thus, the impact force by the ink droplets can efficiently be transmitted, so that high sensitivity and response property can be obtained.

As shown in FIG. 3B, in the case where the contact surface S2 contacts with the piezo film 62 at portions other than the maximum projecting portion, the impact force by the landing of ink droplets on the ink droplet landing surface S1 would be dispersed, and further the dispersed impact force would be received by the curved surface of the piezo film 62, thereby reducing the transmission efficiency of the force, which results in lowering the sensitivity and response property.

Thus, the position of the maximum projecting portion of the curved outer periphery of the piezo film 62 is adapted to be movable, and the nozzle clogging detection part 60 comprises the supporting part 63 and the adjusting part 64 for adapting the maximum projecting portion to the ink droplet landing position. Adaptation of the maximum projecting portion of the curved outer periphery of the piezo film 62 to the ink droplet landing position is successful in adjusting the shape of the piezo film, thereby enabling to adjust the response property of the piezo film 62.

The supporting part 63 curves the piezo film 62 into approximately half cylinder to support it. The supporting part 63 comprises a fixed supporting part 63*a* and a movable supporting part 63*b*. The facing surfaces of the fixed supporting part 63*a* and the movable supporting part 63*b* are provided to be perpendicular to a rotating axis A of a screw 64*a* which will be described later and in parallel with each other.

The piezo film 62 is fixed to the fixed supporting part 63*a* at one end side thereof in a curving direction, and the fixed supporting part 63*a* is provided not to move irrespective of the rotation of the screw 64*a*.

The movable supporting part 63*b* supports the other end side of the piezo film 62 opposing to the one end side of the piezo film 62 in the curving direction which is fixed to the fixed supporting part 63*a*. A female screw hole in which a male screw part of the screw 64*a* is screwed is formed in the movable supporting part 63*b*, so that the movable supporting part 63*b* is movable to be close to or separated from the fixed supporting part 63*a* corresponding to the rotation direction of the screw 64*a*.

The adjusting part 64 comprises the screw 64*a* and a supporting base 64*b*.

The screw 64*a* is disposed such that the rotating axis A of the screw 64*a* is perpendicular to the ink droplet jetting direction B, and is rotatably supported by the supporting base 64*b* and a casing 69. The screw 64*a* has the male screw part in a movable rage of the movable supporting part 63*a*, which is screwed in the female screw hole of the movable supporting part 63*a*.

For example, in FIG. 2A, when the screw 64*a* is rotated in a right-handed screw direction, the movable supporting part 63*b* is moved to the right side, and when the screw 64*a* is rotated in a left-handed screw direction, the movable supporting part 63*b* is moved to the left side.

Accordingly, the other end side of the piezo film 62 can be movably supported to be close to or separated from the one end of the piezo film 62 in the curving direction, and the position of the maximum projecting portion of the curved outer periphery is adapted to the ink droplet landing position, so that the position of the maximum projecting portion of the curved outer periphery can be adjusted right to left and up and down. Therefore, the adjustment of the response property of the piezo film 62 can be realized.

As described above, by providing the supporting part 63 and the adjusting part 64, the curvature of the curved piezo film 62 can be changed to adjust the position of the maximum projecting portion of the curved outer periphery, thus, the distance between the cover 61*a* and the piezo film 62, and the initial shape of the piezo film 62 can be adjusted. Accordingly, in the initial state, appropriate adjustment of the position can be performed so as not to output a signal from the piezo film 62 by some impact (operating vibration of the machine itself, a misalignment of the setting position of the ink receiving member 60, or the like). Appropriate adjustment of the position of the piezo film 62 to the ink droplet landing position is successful in obtaining high response property in the operating state, so that the small changes of the landing of fine ink droplets can be detected with high accuracy.

The rotating operation of the screw 64*a* by the adjusting part 64 may be performed manually or automatically. In the case of automatically performing the rotating operation, for example, a feed screw mechanism may be applied, in which a ball screw or the like is used as the screw 64*a* in the adjusting part 64. That is, for example, in the case of adjusting the initial shape of the piezo film 62, the configuration may be such that the value of rotation amounts corresponding to shape of the piezo film 62 is prestored in the nonvolatile memory which is under the control of the CPU, and the driving force from the drive source which can be controlled by the predetermined control device can be transmitted to the screw 64*a*. Thus, the driving force from the drive source can be controlled based on the stored data in the nonvolatile memory. Thereby, the rotation amount can be automatically adjusted to adjust the position of the maximum projecting portion of the curved outer periphery, so that the initial shape of the piezo film 62 can be adjusted.

Figure 4:
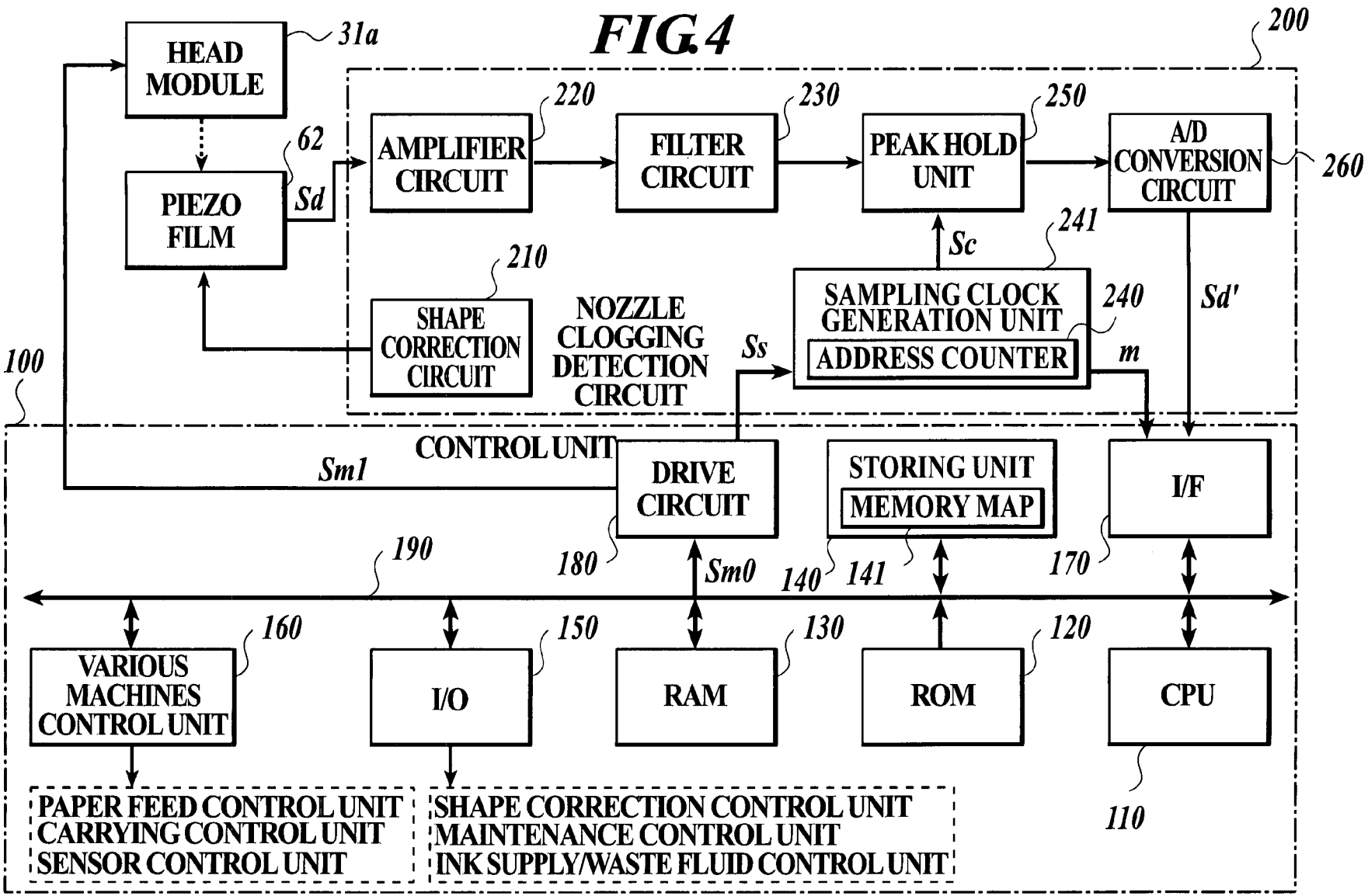
FIG. 4 is a control block diagram for controlling the ink jet printer 1 in the first embodiment.

FIG. 4 shows a control block diagram for controlling the ink jet printer 1 of the first embodiment. As shown in FIG. 4, the control system comprises a control unit 100 and a nozzle clogging detection circuit 200.

In the control unit 100, a CPU (Central Processing Unit) 110 as a control section and a judging section, a ROM (Read Only Memory) 120, a RAM (Random Access Memory) 130, a storing unit 140 as a storing section, an I/O (Input/Output) 150, a various machines control unit 160, an I/F 170, a drive circuit 180 and the like are connected to a system bus 190, and the control unit 100 is connected to the nozzle clogging detection circuit 200 through the I/F 170.

The nozzle clogging detection circuit 200 comprises a shape correction circuit 210, an amplifier circuit 220, a filter circuit 230, a sampling clock generation unit 240 as a sampling section, a peak hold unit 250, an A/D conversion circuit 260 or the like.

The CPU 110 reads out a system program, or various processing programs and data stored in the ROM 120, expanding them in the RAM 130, and performs a central control of operations of the whole ink jet printer 1 according to the programs expanded. That is, the CPU 110 performs a timing control of the whole system, storing and accumulation controls of data with the use of the RAM 130, an output of print data to each head module, an input-output control of an operating portion which is not shown, an interface (I/F) to other applications, or an operation control.

Incidentally, due to the structural feature of the ink jet head, there is a case that ink jetting is not performed for the initial stage of the ink droplet jetting operations, and is recovered after repeating the ink droplet jetting operation a few times, so that ink droplets are jetted in the middle or last half ink droplet detection operations.

Therefore, in the present invention, ink jetting is performed continuously a plurality of times, and the vibration generated when an ink droplet lands is detected in each ink droplet jetting operation. Thus, even if the vibration which is generated when an ink droplet lands is not detected in the initial stage, a judgment is made that there is no nozzle clogging when the ink jetting is recovered after repeating the ink droplet jetting operation a few times, so that the detection accuracy of the nozzle clogging can be improved.

When the ink droplet jetting operation from the nozzles is performed continuously, the cycle of the jet drive signal $S_{m0}$ needs to be set to make the speed of an ink droplet in each ink droplet jetting operation be constant. The ink jet signal $S_{m1}$ for jetting ink droplets from the nozzles is an integral multiple of a standard drive waveform time AL. Thus, the cycle of the jet drive signal $S_{m0}$ is set by multiplying the standard drive waveform time AL by an odd number to stabilize the ink droplet speed.

Figure 5:
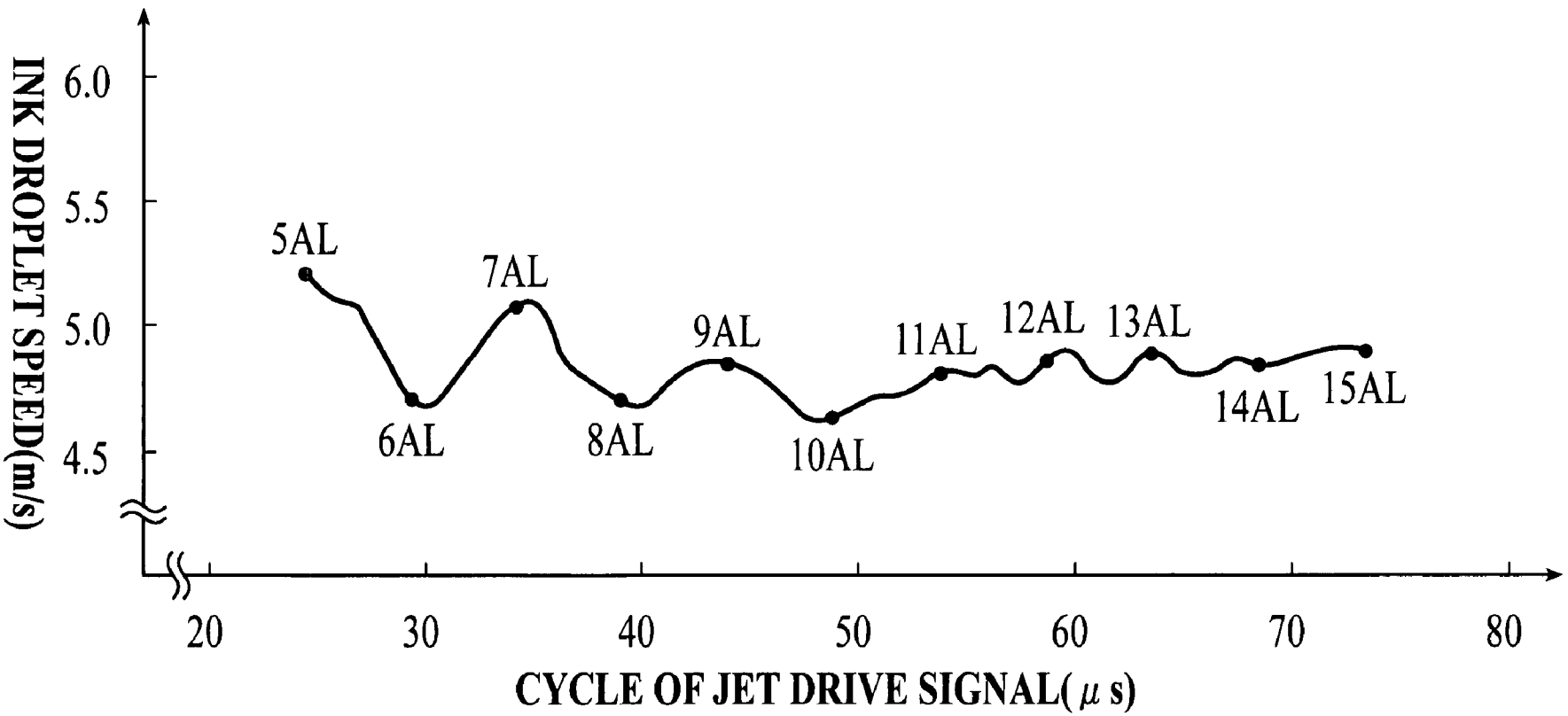
FIG. 5 is a view showing an example of the dependence of an ink droplet speed on a cycle of a jet drive signal.

FIG. 5 is a view showing an example of the dependence of the ink droplet speed on the cycle of the jet drive signal. In the example shown in FIG. 5, when the standard drive waveform time AL is set to be 4.9 [μs], the ink droplet speed of the first ink droplet jetting operation is 5.5 [m/s].

As shown in FIG. 5, when the cycle of the jet drive signal $S_{m0}$ is set by multiplying the standard drive waveform time AL by an even number (6AL, 8AL, 10AL, 12AL and 14AL are shown in FIG. 5), the ink droplet speed decreases, thereby causing the gap in the timing of an ink droplet to land with respect to the first ink droplet jetting operation. Accordingly, the cycle of the jet drive signal $S_{m0}$ is preferably set by multiplying the standard drive waveform time AL by an odd number for setting the ink droplet speed to be approximately equal to the ink droplet speed of the first ink droplet jetting operation. However, when the time is three times of the standard drive waveform time AL, the nozzles are not ready to perform the second ink droplet jetting operation. Thus, the second ink droplet jetting time in the continuous ink droplet jetting operations is set by multiplying the standard drive waveform time AL by an odd number not less than five as the cycle of the jet drive signal $S_{m0}$.

In the example shown in FIG. 5, as the cycle of the jet drive signal $S_{m0}$, the shortest drive timing of the second ink droplet to have a speed close to the ink droplet speed of the first ink droplet jetting operation (5.5 [m/s]) is five times of the standard drive waveform time AL, followed by seven times and then by nine times thereof. Thus, when detecting an ink droplet by jetting two or more ink droplets continuously, it is preferable to set the cycle of the jet drive signal $S_{m0}$ by multiplying the standard drive waveform time AL by seven or nine which is an odd number. Accordingly, the cycle of the jet drive signal $S_{m0}$ is preferably set by multiplying the standard drive waveform time AL by an odd number not less than five, more preferably by an integral number which is one of 5, 7, 9, 11, 13 and 15.

Accordingly, to realize the first embodiment, the CPU 110 calculates the jet drive signal $S_{m0}$ as an instruction signal to continuously jet ink droplets a plurality of times with a jet drive cycle which is set by multiplying the standard drive waveform time of the ink jet signal by an odd number not less than five, and outputs the calculated jet drive signal $S_{m0}$ to the drive circuit 180. The CPU 110 reads out an address of a detected data Sd' as an amplitude value data showing a maximum voltage value $V_{max}$ as a maximum amplitude value in each ink droplet jetting operation from a memory map 141 to be described later which is stored in the storing unit 140, and performs the judgment of the nozzle clogging based on the address number (number of addresses) which was read out. Further, the nozzle clogging judging operation is performed by comparing the maximum voltage value $V_{max}$ which is shown by the detected data Sd' corresponding to the address which was read out and the standard voltage value $V_0$ as a standard value.

When the CPU 100 judges that nozzle clogging exists, the maintenance part 50 is controlled to drive to solve nozzle clogging.

The ROM 120 stores a program or a system program for driving the ink jet printer 1, various programs corresponding to the system, data necessary for processing with the various processing programs and the like.

To realize the first embodiment, the ROM 120 stores the standard voltage value $V_0$ which is the maximum voltage value based on the detected data Sd' when ink droplets are properly jetted onto the ink droplet landing surface S1, a delay time $t_d$ to be described later and a sampling period Ts.

The RAM 130 is a temporally storing region for programs, input or output data, parameters read out from the ROM 120 in various processing controlled and executed by the CPU 110.

The RAM 130 also temporally stores addresses read out from the storing unit 140 by the CPU 110, a sampling number (m) (number of samplings) calculated by a sampling clock generation unit 260 to be described later and the number of ink droplet jetting operations (n) which is set by an operating portion or the like which is not shown, and comprises an ink jet counter for counting the number of ink droplet jetting operations (jet count number N).

To realize the first embodiment, the storing unit 140 stores the detected data Sd' input from the A/D conversion circuit 250 through the I/F in the memory map 141 to correspond to each address.

FIG. 6 shows an example of the memory map 141 stored in the storing unit 140.

As shown in FIG. 6, each address in the memory map 141 consists of an upper address. A1 and a lower address A2. The upper address A1 shows the number of ink droplet jetting operations (n) which was set, and the lower address A2 shows the sampling number (m) in each ink droplet jetting operation, that is, a clock number (number of clocks) of sampling clock signal.

For example, the detected data Sd' stored in the address "01×0001" is the voltage value (amplitude value) of the piezo vibration signal Sd as a detected signal presented in twos complement form when the clock number of the sampling clock signal is 1 in the first ink droplet jetting operation.

The storing unit 140 may be composed by using a part of the storing region of the RAM 130.

The I/O 150 is for input and output of data between the control unit 100 and a control unit of each portion. To realize the first embodiment, the I/O 150 is connected to a shape correction control unit for controlling the shape of the piezo film 62 and a maintenance control unit for controlling the operations of the maintenance part 50, and is also connected to control units such as an ink supply/waste fluid control unit, a waste ink control unit or the like.

The various machines control unit 160 is connected to a paper feed control unit for controlling various rollers and the paper pick up device 12 of the paper feed part 10, a carrying control unit for controlling various rollers of the carrying part 20, and a sensor control unit for driving various sensors provided in the ink jet printer 1 and the like, each of which operates based on the instructions from the CPU 110.

The drive circuit 180 generates and outputs the ink jet signal $S_{m1}$ for jetting ink droplets from the nozzles by driving the nozzles of each head module of each head unit 31, 32, 33, 34, based on the print data and the jet drive signal $S_{m0}$ from the CPU 110. Also, the drive circuit 180 generates and outputs a sampling start signal Ss which is output after a lapse of a delay time $t_d$ from a rise time as a generation time of the jet drive signal $S_{m0}$. The generated ink jet signal $S_{m1}$ is output to the nozzles of each head module and the sampling start signal Ss is output to the sampling clock generation unit 260.

The delay time td is determined as the time corresponding to the time needed for ink droplets to land based on the drive waveform condition of the ink jet signal $S_{m1}$. The drive waveform condition is determined based on the ink type to be jetted (for example, water-based ink, oil-based ink, ultraviolet curable ink, solid ink or the like), the jetting method (piezo system using piezoelectric elements, thermal system using a heater, or the like), a head configuration or the like.

For example, in a case of a head of piezo system, an ink droplet jetting operation is performed by the ink jet signal $S_{m1}$ having two drive waveforms. In this case, a positive voltage waveform is called "ON waveform", and a negative voltage waveform is called "OFF waveform". A time period of the "ON waveform" (that is, the standard drive waveform time AL) is a standard for ink droplet jetting operations.

The delay time $t_d$ is set to be twice of the standard drive waveform time AL of the ink jet signal $S_{m1}$.

The sampling start signal Ss is a signal for instructing detection of the piezo vibration signal Sd, and a time period Ts (hereinafter, referred to as a sampling time period) for detecting the piezo vibration signal Sd shows a "LOW" state.

For example, in a case of a head of piezo system, the time slot of the sampling time period Ts is set to be twice of the standard drive waveform time AL with the rise time of the "OFF waveform" of the ink jet signal $S_{m1}$ as a center.

The shape correction circuit 210 adjusts the output signal from the piezo film 62 based on the instructions from the shape correction control unit to make the piezo vibration signal Sd to be output constant within the range of the preset initial value in a case that the piezo film 62 is in the initial condition.

The piezo vibration signal Sd as a detection signal output from the piezo film 62 is amplified and adjusted by the amplifier circuit 220, and is subjected to filtering out noise with the filter circuit 230. The denoised piezo vibration signal Sd is input to the peak hold unit 250.

The sampling clock generation unit 240 receives the sampling start signal Ss and the sampling time period Ts input from the drive circuit 180, and generates a sampling clock signal Sc which is a clock signal with a constant frequency to calculate the sampling number (m). The generated sampling clock signal Sc is output to the peak hold unit 250, and the calculated sampling number (m) is output to the control unit 100.

The sampling clock generation unit 240 comprises an address counter 241 for counting the clock number of the generated sampling clock signal Sc, and an address count number (M) (number of addresses counted) is output to the control unit 100.

Preferably, the cycle of the sampling clock signal Sc is set with the number of sampling data, the capacity of the storing unit 140, the data collection function and the like optimized. When the cycle is shortened and the sampling number is increased, it may increase the case to read the same data continuously, and may make the read time of the data from the storing unit 140 long, which may result in long nozzle clogging judging operations.

Therefore, the cycle of the sampling clock signal Sc can be calculated depending upon the time slot of the sampling time period Ts of the sampling start signal Ss. For example, in a case of a head of piezo system, when the sampling time period Ts is set to be twice of the standard drive waveform time AL, the sampling clock signal Sc with a cycle of one tenth of the standard drive waveform time AL can be calculated.

The peak hold unit 250 extracts the piezo vibration signal Sd input from the filter circuit 230 in the sampling time period Ts based on the sampling clock signal Sc input from the sampling clock generation unit 240 for each clock. The extracted piezo vibration signals Sd are subjected to A/D conversion by the A/D conversion circuit 260, and are stored in the memory map 141 of the storing unit 140 through the I/F 170 as the detected signal Sd'.

As described above, the piezo vibration signal Sd needs to be detected only in the sampling time period Ts, so that unnecessary signal is not detected, thereby improving detection accuracy of a jet failure of the nozzles.

Figures 7A, 7B:
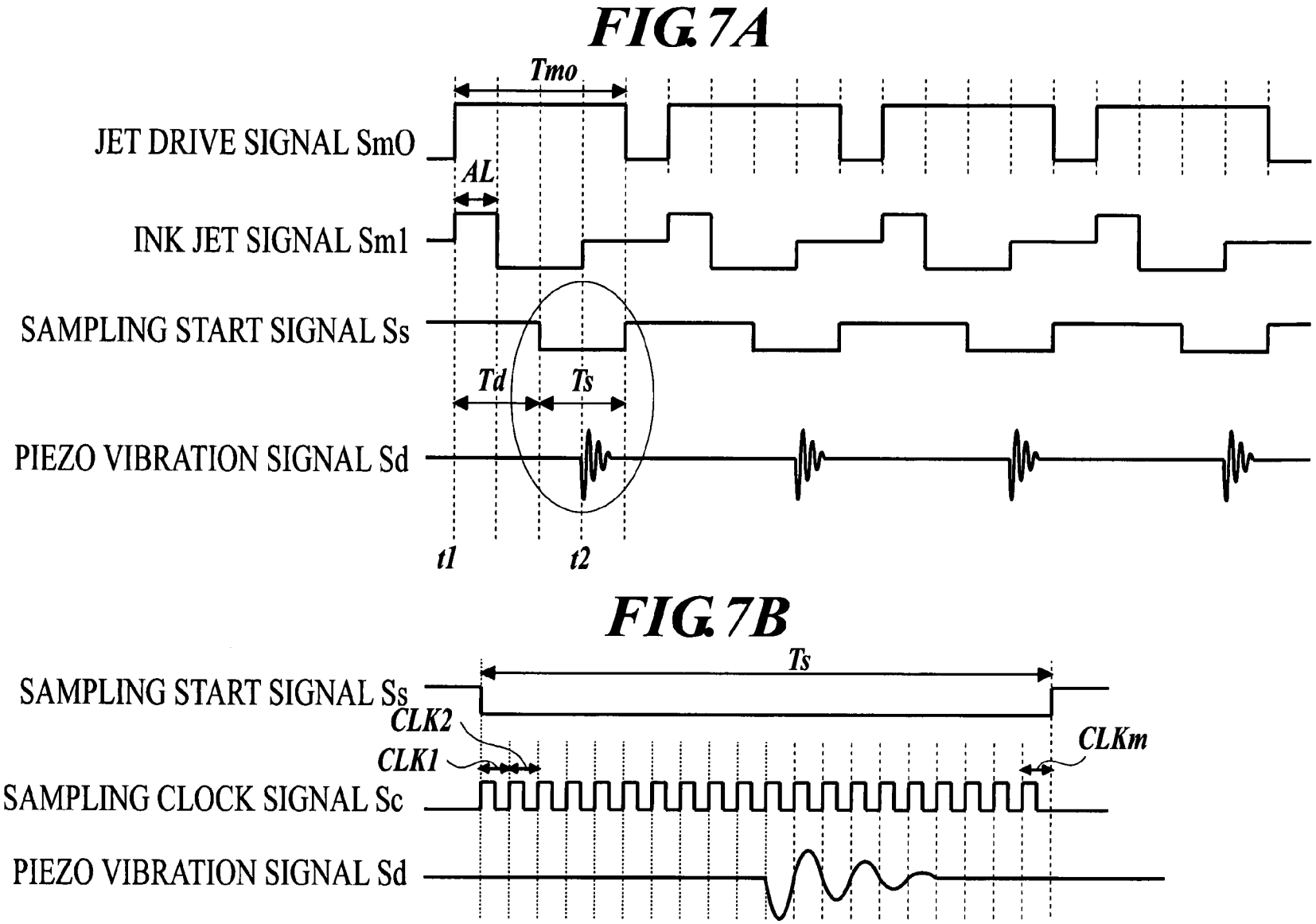
FIG. 7A is an example of a time chart of a jet drive signal $S_{m0}$, an ink jet signal $S_{m1}$ output based on the jet drive signal $S_{m0}$, a sampling start signal Ss and a piezo vibration signal Sd output based on the ink jet signal $S_{m1}$.
FIG. 7B is an example of a time chart of the sampling start signal Ss, the piezo vibration signal Sd, and a sampling clock signal Sc in a sampling period Ts shown in FIG. 7A.

FIGS. 7A and 7B show examples of time charts of ink droplet jetting operations from nozzles.

FIG. 7A shows the jet drive signal $S_{m0}$ as a signal to instruct the ink droplet jetting operations output to the drive circuit 180 from the CPU 110, the ink jet signal $S_{m1}$ output to the head of the head module 31*a* from the drive circuit 180 based on the jet drive signal $S_{m0}$, the sampling start signal Ss output to the sampling clock generation unit 240 from the drive circuit 180, and the piezo vibration signal Sd output from the piezo film 62 based on the ink jet signal $S_{m1}$.

FIG. 7B shows an example of the sampling start signal Ss, the piezo vibration signal Sd, and the sampling clock signal Sc output to the peak hold unit 250 from the sampling clock generation unit 240 in the sampling time period Ts shown in FIG. 7A.

As shown in FIG. 7A, for example, the cycle $T_{m0}$ of the jet drive signal $S_{m0}$ is set to be five times of the standard drive waveform time AL. When the jet drive signal $S_{m0}$ is output at time t1, the ink jet signal $S_{m1}$ is output. When the delay time td passes from the rise time t1 of the jet drive signal $S_{m0}$, the sampling start signal Ss is output. The sampling time period Ts is set to be twice of the standard drive waveform time AL with the rise time t2 of the "OFF waveform" of the ink jet signal $S_{m1}$ as a center. Ink droplets land on the ink droplet landing surface S1 in the sampling time period Ts, so that the piezo vibration signal Sd is output.

As shown in FIG. 7B, in the sampling time period Ts, the sampling clock signal Sc is output based on the sampling start signal Ss, the piezo vibration signal Sd is extracted based on the sampling start signal Ss for each clock, and nozzle clogging judging operation is performed.

Next, description will be made for the nozzle clogging judging operation performed by the control unit 100.

Figure 8:
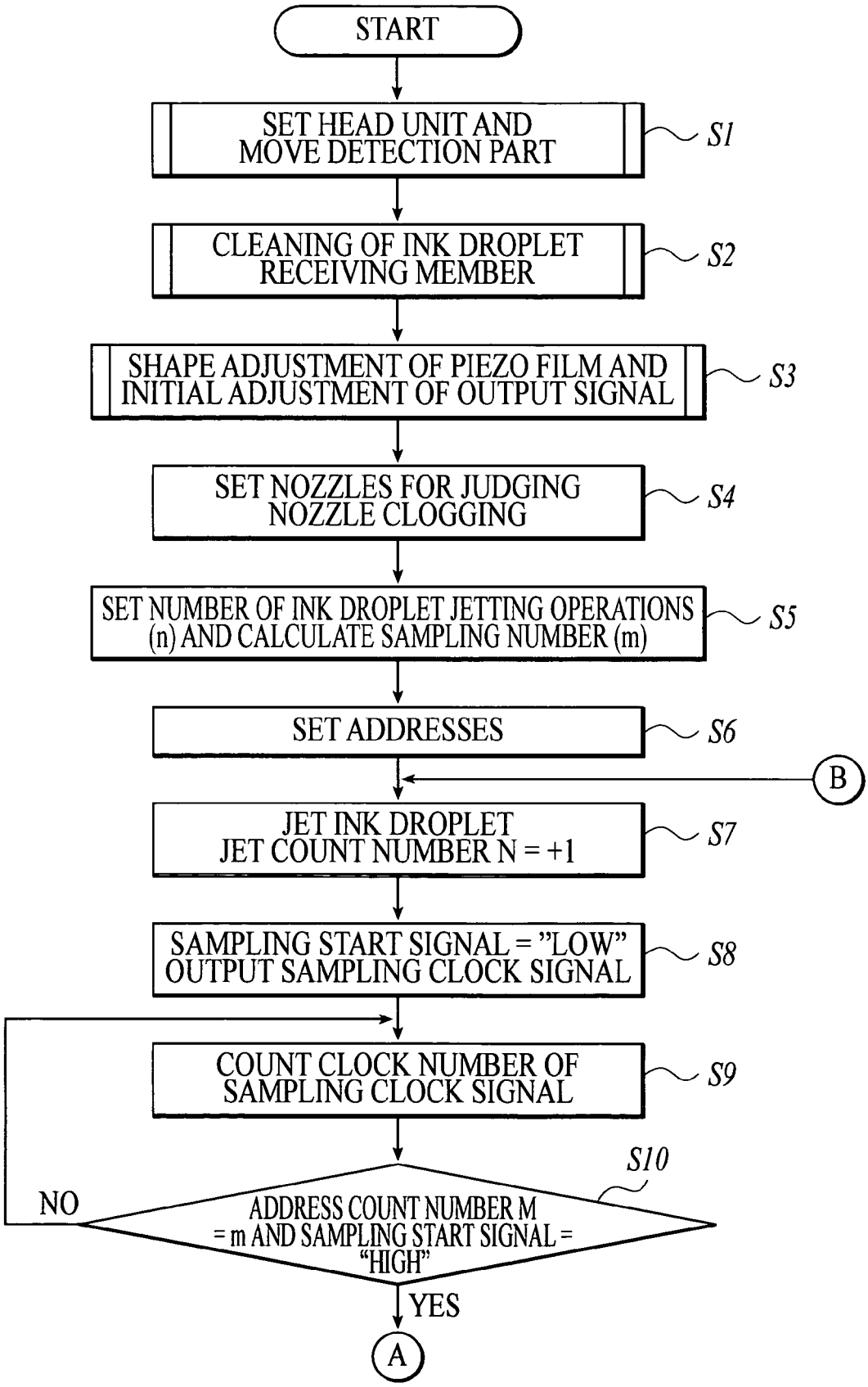
FIG. 8 is a flow chart of a nozzle clogging judging operation in the first embodiment.
Figure 9:
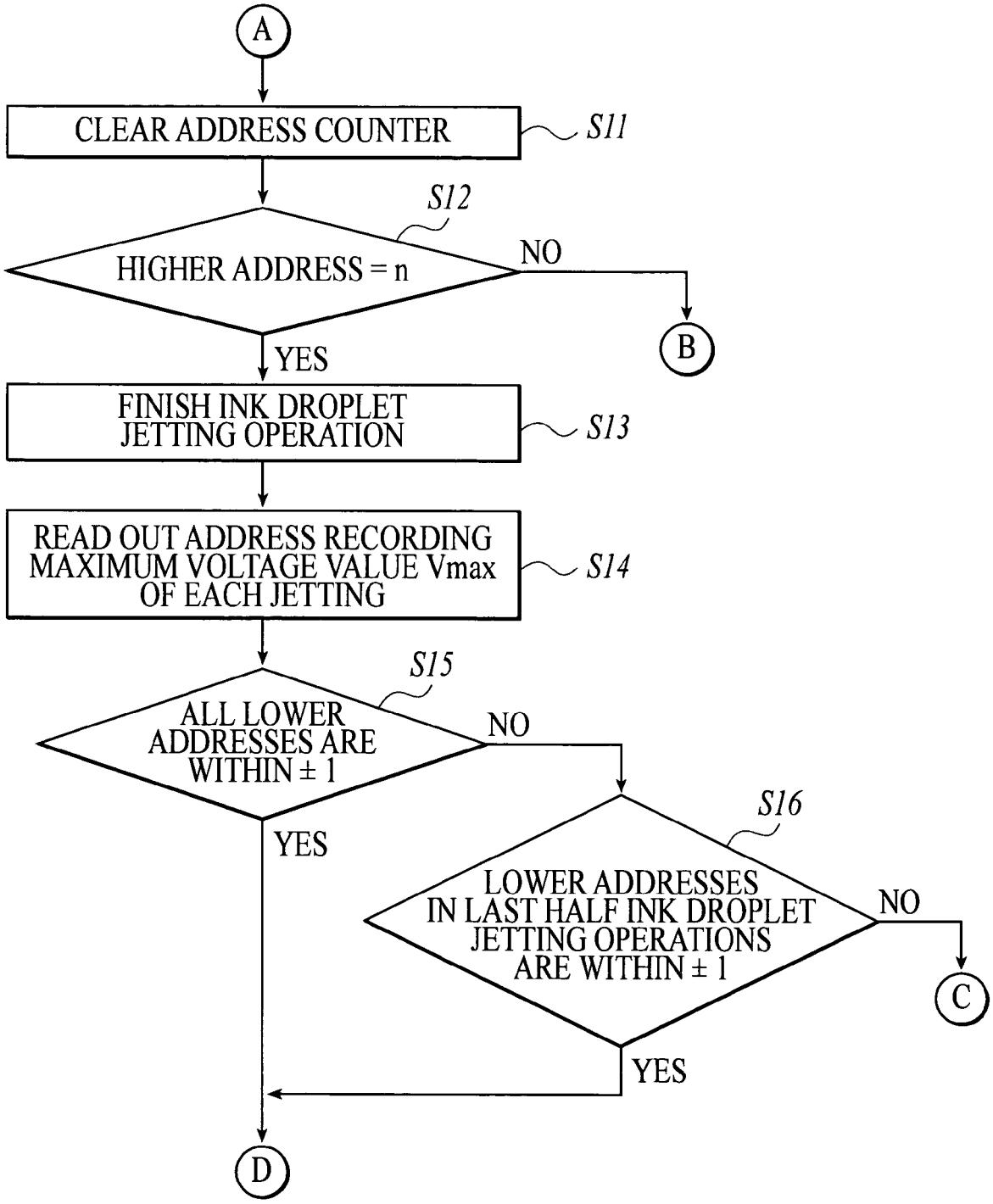
FIG. 9 is a flow chart continuing from FIG. 8 to illustrate the nozzle clogging judging operation in the first embodiment.
Figure 10:
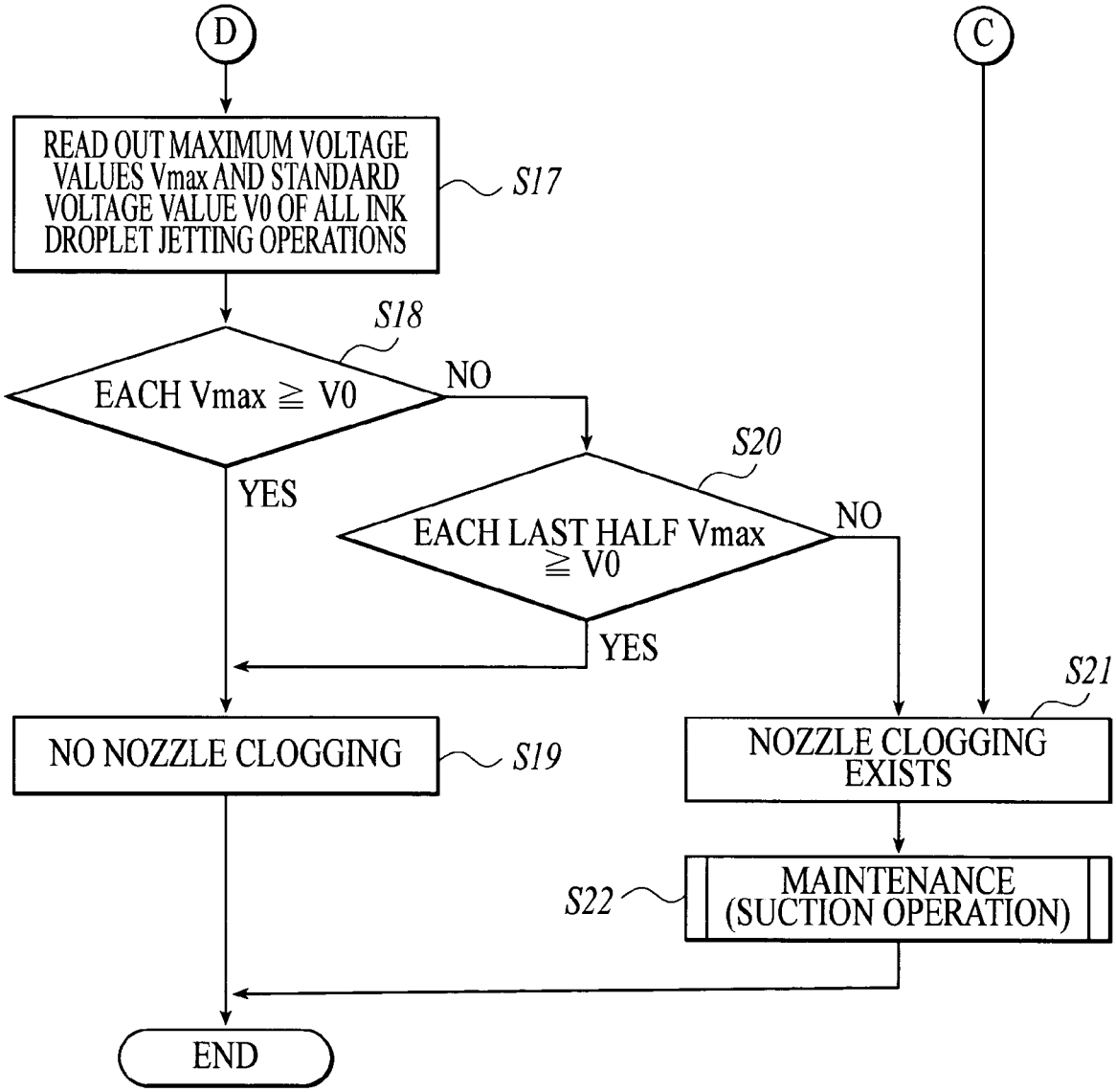
FIG. 10 is a flow chart continuing from FIG. 9 to illustrate the nozzle clogging judging operation in the first embodiment.

FIGS. 8 to 10 show flow charts of the nozzle clogging judging operation of the first embodiment.

The head unit which is subjected to the nozzle clogging judgment is set. Thereafter, the nozzle clogging detection part 60 is moved to a predetermined position below the set head unit (Step S1).

After the nozzle clogging detection part 60 was moved to the predetermined position, cleaning of the ink droplet receiving part 61 is performed, and mechanical vibration of the nozzle clogging detection part 60 is stopped (Step S2).

After the cleaning of the ink droplet receiving part 61, the shape of the piezo film 62 is adjusted. Also, the output signal output from the piezo film 62 is adjusted so that the piezo vibration signal Sd to be output from the piezo film 62 is constant within the range of the preset initial value (Step S3).

After the initial setting of the output signal from the piezo film 62, nozzles for judging nozzle clogging are set (Step S4).

The number of ink droplet jetting operations (n) is set by an operating portion or the like, and the sampling number (m) is calculated based on the sampling time period Ts and the sampling clock signal Sc (Step S5).

In the storing unit 140, addresses are set based on the number of ink droplet jetting operations (n) and the sampling number (m), and the setting of the memory map for storing detected data Sd' is performed (Step S6).

One is added to the jet count number N of the ink jet counter (adding one to a reference upper address), and the ink jet signal $S_{m1}$ is output to the set nozzles to jet ink droplets (Step S7).

After the lapse of the delay time $t_d$, the sampling start signal Ss is output (the sampling start signal Ss is in a "LOW" state), and the sampling clock signal Sc starts to be output (Step S8).

The address counter 241 counts a clock number of the sampling clock signal Sc (Step S9).

A maximum voltage value in the piezo vibration signal Sd is detected for each clock of the sampling clock signal Sc, and is subjected to A/D conversion. Thereafter, the piezo vibration signal Sd (that is, a detected data Sd' for each clock) is stored in an appropriate address based on the jet count number N and the address count number (M) with reference to the addresses in the memory map 141.

A judgment is made whether the value of the reference lower address is equal to the sampling number (m) (that is, the address count number (M) is equal to the sampling number (m)), and the sampling start signal Ss is in the "HIGH" state (Step S10). If these conditions are not satisfied (Step S10; No), the operation is returned to Step S9.

When the address count number (M) is equal to the sampling number (m), and the sampling start signal Ss is in the "HIGH" state (Step S10; Yes), the address counter 241 is cleared (that is, the reference lower address is set to "0") (Step S11).

A judgment is made whether the reference upper address is equal to the number of ink droplet jetting operations (n) (that is, the jet count number N is equal to the number of ink droplet jetting operations (n)) (Step S12). When the reference upper address is not equal to the number of ink droplet jetting operations (n) (Step S12; No), the operation is returned to Step S7.

When the reference upper address is equal to the number of ink droplet jetting operations (n) (Step S12; Yes), the ink droplet jetting operation is finished (Step S13).

The addresses in each of which the maximum voltage value $V_{max}$ for each ink droplet jetting operation is stored are read out from the memory map 141 (Step S14).

Preferably, there is one lower address in the addresses in each of which the maximum voltage value for each ink droplet jetting operation is stored, however, due to the relationship between the cycle of the sampling clock signal Sc and that of the piezo vibration signal Sd, there may be a case where a plurality of lower addresses storing the maximum voltage value with the same voltage consecutively exists.

In the embodiment, a judgment is made whether lower addresses in the addresses read out for the ink droplet jetting operations are either the same or three consecutive numbers. Hereinafter, it is defined as "judging whether the lower addresses are within ±1".

When the lower addresses are within ±1 (that is, one lower address having the same maximum voltage value exists, or three or less consecutive lower addresses have the same maximum voltage value), it can be judged that the maximum voltage value exists in one lower address, or the same maximum voltage value exist in three or less consecutive lower addresses. Thus, a judgment can be made that there is no nozzle clogging. When the lower addresses are not within ±1, it can be judged that there is no address indicating the maximum voltage value, or the same maximum voltage value exists in four or more consecutive lower addresses. Thus, a judgment can be made that there was no vibration or impact by ink droplets, thereby it can be judged that nozzle clogging exists.

In the first embodiment, explanation is made to the case in which the lower addresses need to be within ±1, however, it may be within ±2 to 4, that is, it is preferable to set the address number with which a judgment can be made that there is no nozzle clogging based on the address number which would exists considering the relationship between the cycle of the sampling clock signal and that of the piezo vibration signal Sd.

A judgment is made whether the lower addresses in the addresses read out for all ink droplet jetting operations are within ±1 (Step S15).

When not all the lower addresses in the addresses read out for all ink droplet jetting operations are not within ±1 (Step S15; No), a judgment is made whether the lower addresses in the addresses read out in the last half ink droplet jetting operations are within ±1 (Step S16). When not all the lower addresses in the addresses read out in the last half ink droplet jetting operations are not within ±1 (Step S16; No), the ink droplet jetting operations are judged to be abnormal, therefore, a judgment is made that there is nozzle clogging (Step S21).

When all the lower addresses in the addresses read out in all ink droplet jetting operations or in the last half ink droplet jetting operations are within ±1 (Step S15; Yes, Step S16; Yes), the maximum voltage values $V_{max}$ written in the addresses read out in all ink droplet jetting operations and the standard voltage value $V_0$ stored in the ROM 120 are read out (Step S17).

In the judgmental step (S18) as a judgmental section, a judgment is made whether each maximum voltage value $V_{max}$ of the ink droplet jetting operations which was read out is not less than the standard voltage value $V_0$.

When each maximum voltage value $V_{max}$ is not less than the standard voltage value $V_0$ (Step S18; Yes), the ink droplet jetting operations are judged to be normal, therefore, a judgment is made that there is no nozzle clogging (Step S19).

When not all the maximum voltage values $V_{max}$ are not less than the standard voltage value $V_0$ (Step S18; No), a judgment is made whether each maximum voltage value $V_{max}$ in the last half of the ink droplet jetting operations is not less than the standard voltage value $V_0$ (Step S20).

When each maximum voltage value $V_{max}$ in the last half of the ink droplet jetting operations is not less than the standard voltage value $V_0$ (Step S20; Yes), the ink droplet jetting operations are judged to be normal, and a judgment is made that there is no nozzle clogging (Step S19).

When not all the maximum voltage values $V_{max}$ in the last half of the ink droplet jetting operations are not less than the standard voltage value $V_0$ (Step S20; No), the ink droplet jetting operations are judged to be abnormal, and a judgment is made that nozzle clogging exists (Step S21).

When the judgment was made that nozzle clogging exists, the maintenance operation for solving the nozzle clogging (for example, suction operation or the like) is performed to the head module having the nozzles which need the maintenance (Step S22).

Ink droplets are jetted from the nozzles predetermined times, reading out an address of a detected data Sd' indicating the maximum voltage value $V_{max}$ for each ink droplet jetting operation, performing a judgment of nozzle clogging based on the address number which was read out, and further comparing each maximum voltage value $V_{max}$ shown by the detected data Sd' corresponding to each address which was read out with the standard voltage value $V_0$. When not all the maximum voltage values $V_{max}$ are not less than the standard voltage value $V_0$, a judgment is made that ink droplets are not jetted from the set nozzles (that is, nozzle clogging exists). Further, due to the structural feature of the ink jet head, there is a case that ink jetting is not performed for the initial stage of the ink droplet jetting operations, and is recovered after repeating ink droplet jetting operation a few times, so that ink droplets are jetted in the last half ink droplet detection operations to detect the maximum voltage values $V_{max}$. Even in such the case, a judgment can be made that there is no nozzle clogging, thereby enabling to properly perform the maintenance operation only in the case when the maintenance operation is needed.

Accordingly, the landing of in droplets can be detected by using a vibration detection portion (for example, piezo film) with high accuracy, and nozzle clogging can be detected with easy structure. This results in a decrease of the cost for the apparatus.

[Second Embodiment]

The second embodiment will be explained referring to the drawings.

The configuration will be explained first.

The schematic configuration of the inside of an ink jet printer, an end surface of the nozzle clogging detection part 60, and the cross section of a contact state of the contact surface S2 of the cover 61*a* and the piezo film 62 in the second embodiment are the same as those in the first embodiment, therefore the explanations are omitted here and they are not shown in the drawings.

Figure 11:
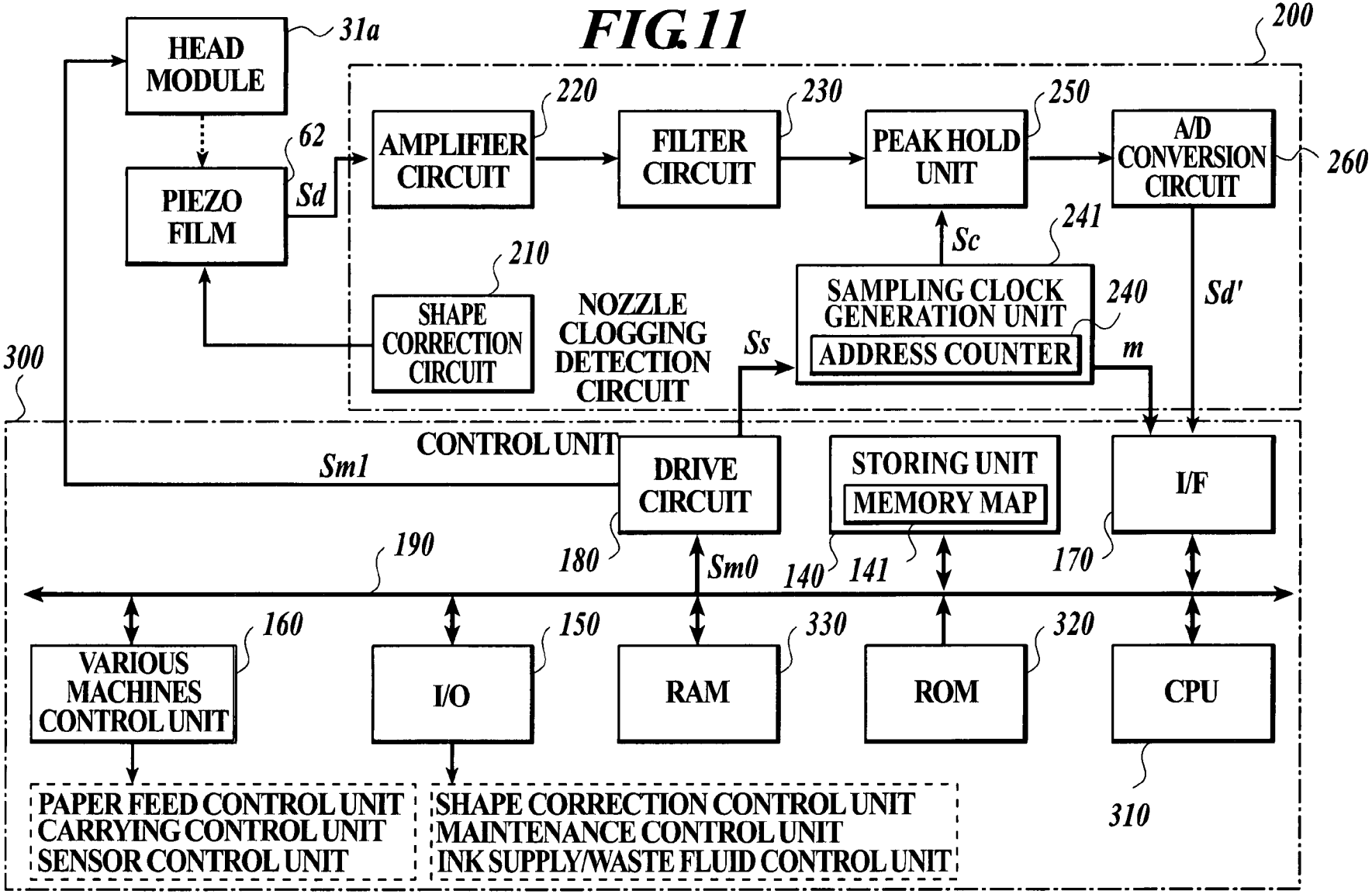
FIG. 11 is a control block diagram for controlling the ink jet printer in the second embodiment.

FIG. 11 shows a control block diagram for controlling the ink jet printer of the second embodiment.

In the control block diagram of the second embodiment, the component that is same as in the first embodiment will be given the same reference numeral and the detailed explanations thereof will be omitted, thus only the component which is different will be explained.

In the control unit 300, a CPU 310 as a control section and a judging section, a ROM 320, a RAM 330, a storing unit 140 as a storing section, an I/O 150, a various machines control unit 160, an I/F 170, a drive circuit 180 and the like are connected to a system bus 190, and the control unit 300 is connected to the nozzle clogging detection circuit 200 through the I/F 170.

The CPU 310 reads out a system program, or various processing programs and data stored in the ROM 320, expanding them in the RAM 330, and performs a central control of operations of the whole ink jet printer according to the programs expanded. That is, the CPU 310 performs a timing control of the whole system, storing and accumulation controls of data with the use of the RAM 330, an output of print data to each head module, an input-output control of an operating portion which is not shown, an interface (I/F) to other applications, or an operation control.

In the ink jet printer, after removing the capping, or in a state of not performing a print recording for a while, the ink viscosity increases due to the evaporation of the moisture in ink or the like, so that it is difficult to perform the ink droplet jetting operation. Especially, in water-based pigmented ink, it is more likely to occur, and there is a case that the ink droplet jetting operation is not performed even when the jet drive signal is given. However, the ink jetting droplet operation may be recovered after repeating the ink droplet jetting operation a few times (corresponding to the flashing operation in the maintenance operation).

The ink jet printer causing such phenomenon may cause the same phenomenon in the ink droplet detection operation. Thus, in the present invention, in a case of performing the ink droplet detection operation after performing the ink droplet jetting operation a few times, when the ink droplet jetting operation is performed the predetermined number of times (n times), the ink droplet detection data of the first half ink droplet jetting operations is not used as the data to judge nozzle clogging, and the judgment of the nozzle clogging is performed based on the ink droplet detection data of the last half ink droplet jetting operations (from n/2 times).

The dependence of the ink droplet speed on the cycle of the jet drive signal $S_{m0}$ is same as that in the first embodiment. That is, as the cycle of the jet drive signal $S_{m0}$, the shortest drive timing of the second ink droplet to have a speed close to the ink droplet speed of the first ink droplet jetting operation (5.5 [m/s]) is five times of the standard drive waveform time AL, followed by seven times and then by nine times thereof. Thus, when detecting an ink droplet by jetting two or more ink droplets continuously, it is preferable to set the cycle of the jet drive signal $S_{m0}$ by multiplying the standard drive waveform time AL by seven or nine which is an odd number. Accordingly, the cycle of the jet drive signal $S_{m0}$ is preferably set by multiplying the standard drive waveform time AL by an odd number not less than five, more preferably by an integral number which is one of 5, 7, 9, 11, 13 and 15. The detailed explanation and the drawings thereof are omitted here.

Accordingly, to realize the second embodiment, the CPU 310 calculates the jet drive signal $S_{m0}$ as an instruction signal to continuously jet ink droplets n times with a jet drive cycle which is set by multiplying the standard drive waveform time of the ink jet signal by an odd number not less than 5, and outputs the calculated jet drive signal $S_{m0}$ to the drive circuit 180. The CPU 310 reads out an address of a detected data Sd' as an amplitude value data showing a maximum voltage value $V_{max}$ as a maximum amplitude value in each ink droplet jetting operation in the last half ink droplet jetting operations (from n/2 times) from the memory map 141 to be described later which is stored in the storing unit 140, and performs the judgment of the nozzle clogging based on the address number (number of addresses) which was read out. Further, the nozzle clogging judging operation is performed by comparing the maximum voltage value $V_{max}$ which is shown by the detected data Sd' corresponding to the address which was read out and the standard voltage value $V_0$ as a standard value.

When the control unit 310 judges that nozzle clogging exists, the maintenance part 50 is controlled to drive to solve nozzle clogging.

The ROM 320 stores a program or a system program for driving the ink jet printer, various programs corresponding to the system, data necessary for processing with the various processing programs and the like.

To realize the second embodiment, the ROM 320 stores the standard voltage value $V_0$ which is the maximum voltage value based on the sampling detected signal Sd' when ink droplets are properly jetted onto the ink droplet landing surface S1, a delay time $t_d$ to be described later and a sampling period Ts.

The RAM 330 is a temporally storing region for programs, input or output data, parameters read out from the ROM 320 in various processing controlled and executed by the CPU 310.

The RAM 330 also temporally stores addresses read out from the storing unit 140, a sampling number (m) (number of samplings) calculated by a sampling clock generation unit 260 to be described later and the number of ink droplet jetting operations (n) which is set by an operating portion or the like which is not shown, and comprises an ink jet counter for counting the number of ink droplet jetting operations (jet count number N).

An example of a time chart of an ink droplet jetting operation from the nozzles is approximately the same as that in the first embodiment, thus, the drawings and the explanation thereof will be omitted here.

Next, description will be made for the nozzle clogging judging operation performed by the control unit 300.

Figure 12:
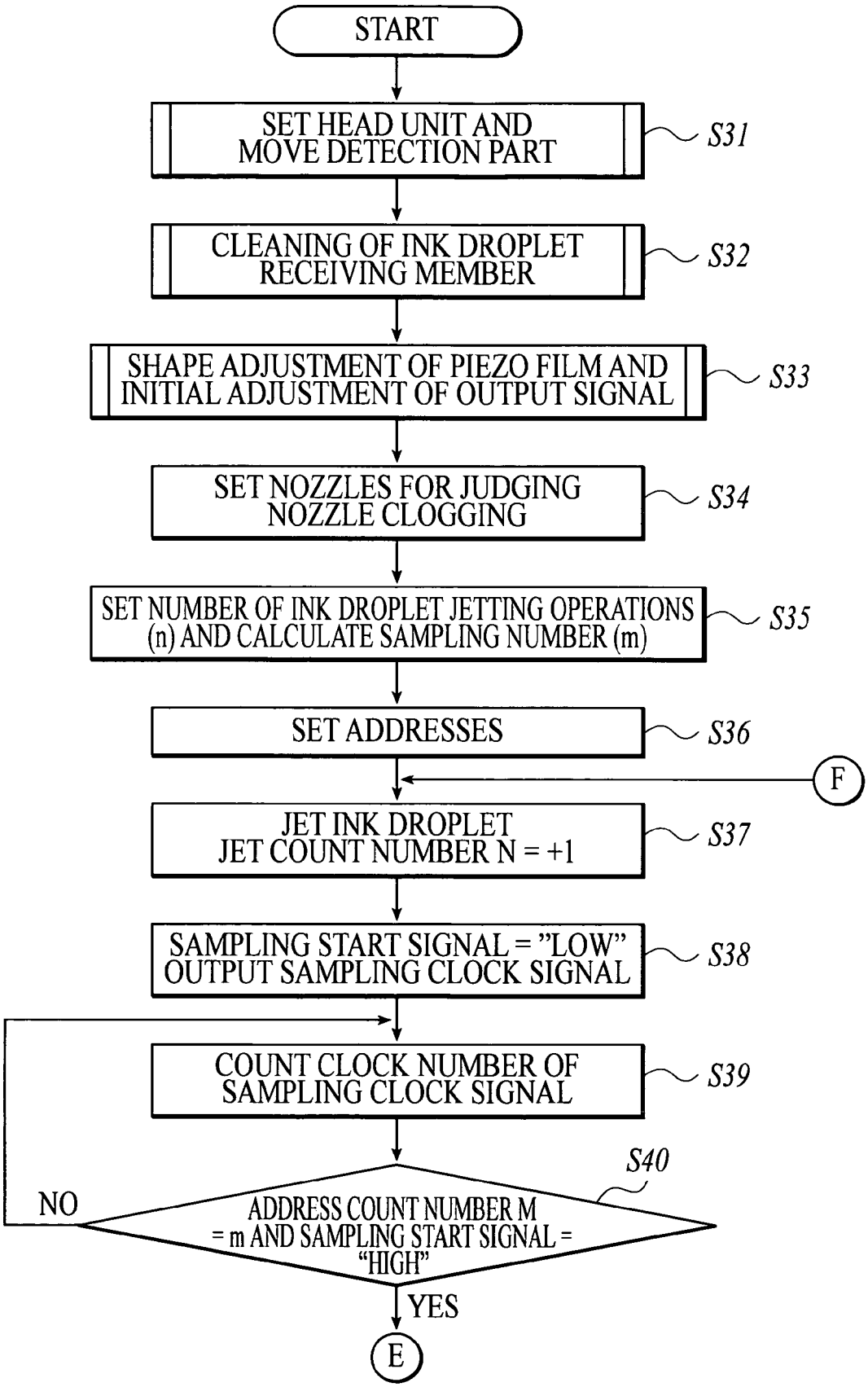
FIG. 12 is a flow chart of a nozzle clogging judging operation in the second embodiment.
Figure 13:
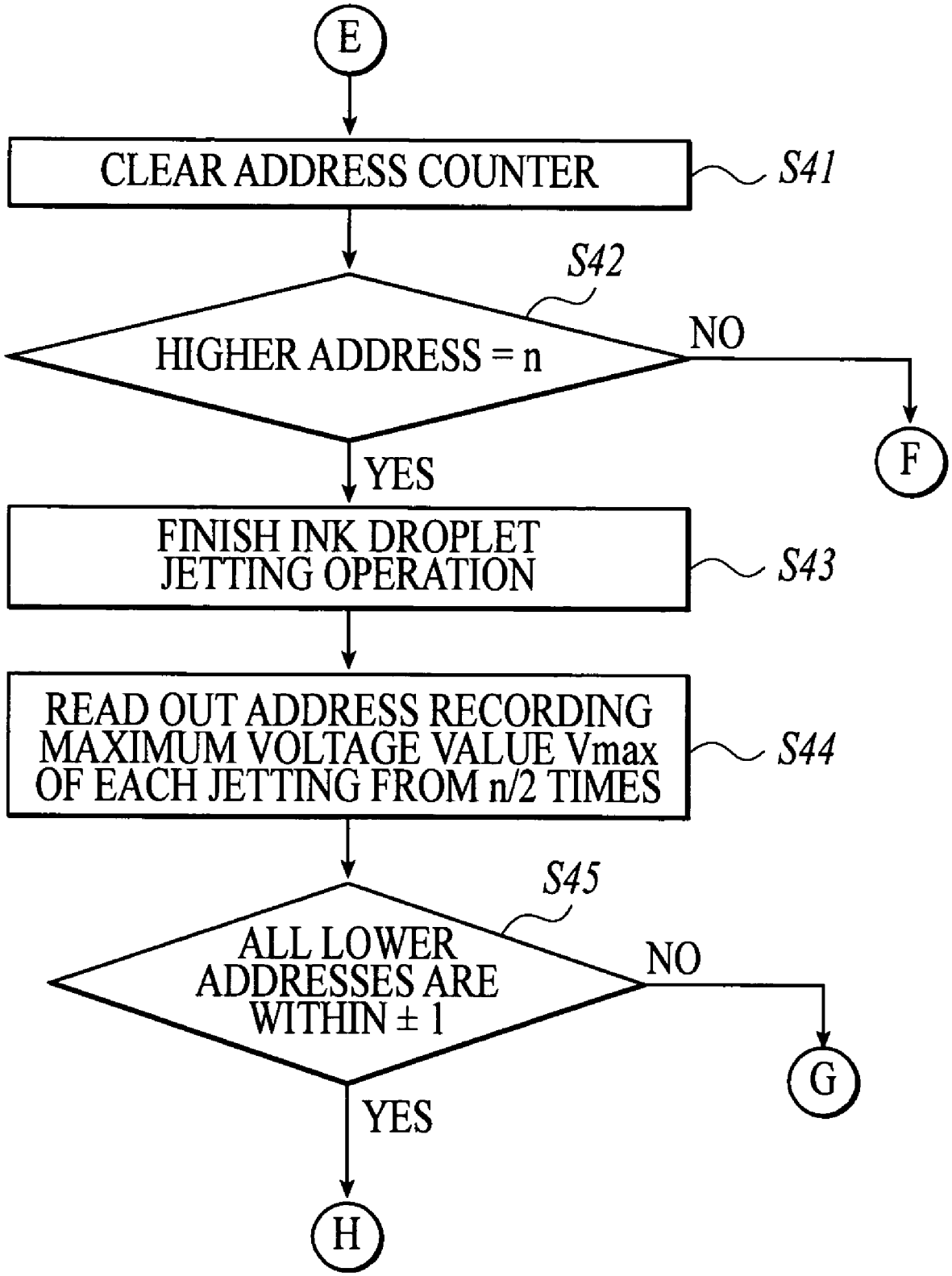
FIG. 13 is a flow chart continuing from FIG. 12 to illustrate the nozzle clogging judging operation in the second embodiment.
Figure 14:
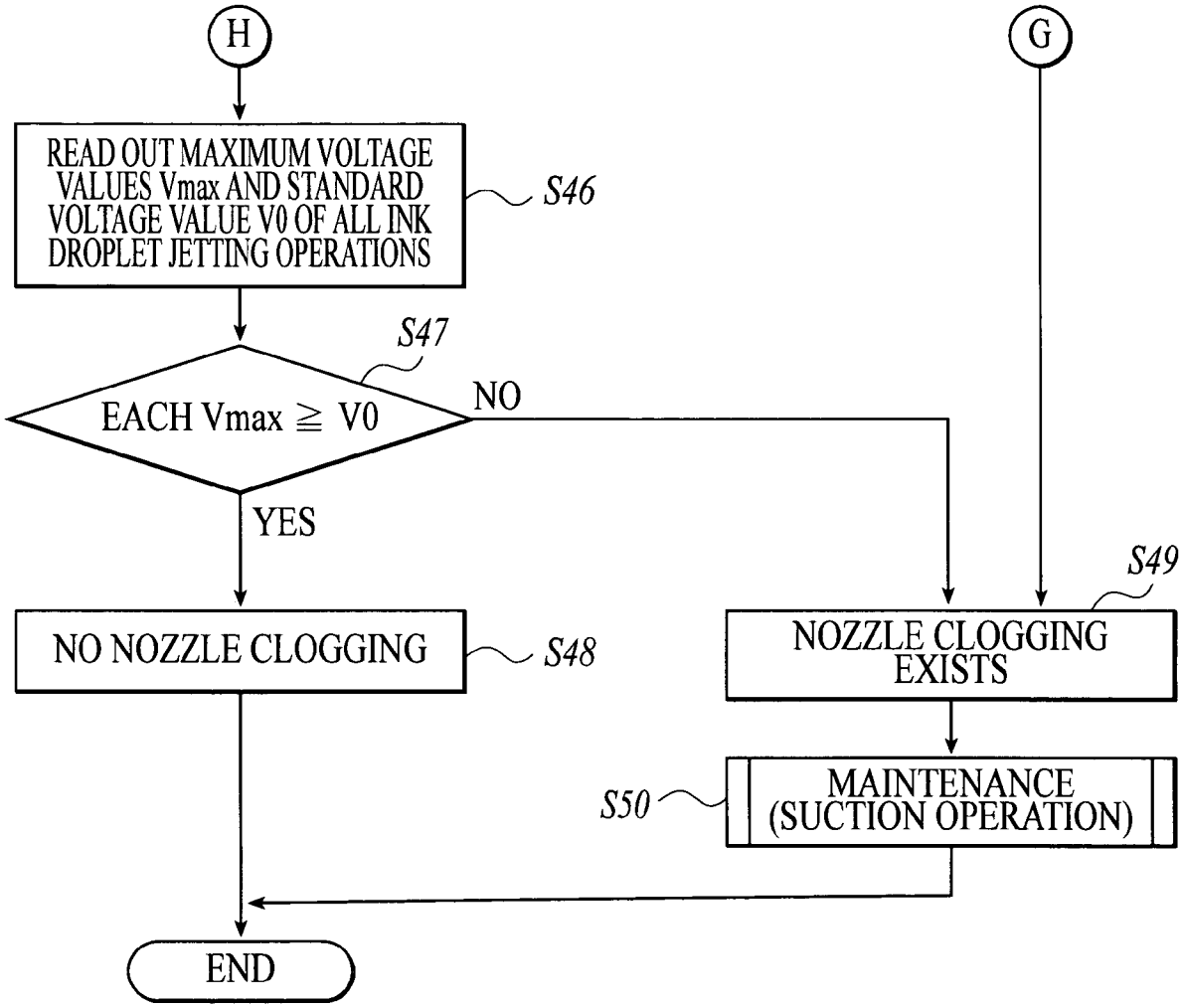
FIG. 14 is a flow chart continuing from FIG. 13 to illustrate the nozzle clogging judging operation in the second embodiment.

FIGS. 12 to 14 show flow charts of the nozzle clogging judging operation of the second embodiment.

Steps S31 to S43 are same as Steps S1 to S13 in the first embodiment, therefore the explanations thereof are omitted.

After finishing the ink droplet jetting operation (after Step S43), the addresses in each of which the maximum voltage value $V_{max}$ for each ink droplet jetting operation in the last half ink droplet jetting operations (from n/2 times) is stored are read out from the memory map 141 (Step S44).

The explanation of the address number in each of which the maximum voltage value for each ink droplet jetting operation is stored is same as that in the first embodiment, thus, the explanation thereof will be omitted here.

A judgment is made whether lower addresses in the addresses read out for the ink droplet jetting operations in the last half ink droplet jetting operations (from n/2 times) are within ±1 (Step S45).

When not all the lower addresses in the addresses read out for all ink droplet jetting operations in the last half ink droplet jetting operations (from n/2 times) are not within ±1 (Step S45; No), the ink droplet jetting operations are judged to be abnormal, therefore, a judgment is made that there is nozzle clogging (Step S49).

When all the lower addresses in the addresses read out for all ink droplet jetting operations in the last half ink droplet jetting operations (from n/2 times) are within ±1 (Step S45; Yes), the maximum voltage values $V_{max}$ written in the addresses read out in all ink droplet jetting operations in the last half ink jetting operations (from n/2 times) and the standard voltage value $V_0$ stored in the ROM 320 are read out (Step S46).

In the judgmental step (S47) as a judgmental section, a judgment is made whether each maximum voltage value $V_{max}$ of the ink droplet jetting operations which was read out is not less than the standard voltage value $V_0$.

When each maximum voltage value $V_{max}$ is not less than the standard voltage value $V_0$ (Step S47; Yes), the ink droplet jetting operations are judged to be normal, therefore, a judgment is made that there is no nozzle clogging (Step S48).

When not all the maximum voltage values $V_{max}$ are not less than the standard voltage value $V_0$ (Step S47; No), the ink droplet jetting operations are judged to be abnormal, and a judgment is made that nozzle clogging exists (Step S49).

When the judgment was made that nozzle clogging exists, the maintenance operation for solving the nozzle clogging (for example, suction operation or the like) is performed to the head module having the nozzles which need the maintenance (Step S50).

Ink droplets are jetted from the nozzles predetermined times (n times), reading out an address of a detected data Sd' indicating the maximum voltage value $V_{max}$ for each ink droplet jetting operation in the last half ink jetting operations (from n/2 times), performing a judgment of nozzle clogging based on the address number which was read out, and further comparing each maximum voltage value $V_{max}$ shown by the detected data Sd' corresponding to each address which was read out with the standard voltage value $V_0$. When not all the maximum voltage values $V_{max}$ are not less than the standard voltage value $V_0$, a judgment is made that ink droplets are not jetted from the set nozzles (that is, nozzle clogging exists). Further, due to the structural feature of the ink jet head, there is a case that ink jetting is not performed for the initial stage of the ink droplet jetting operations, and is recovered after repeating ink droplet jetting operation a few times, so that ink droplets are jetted in the last half ink droplet detection operations to detect the maximum voltage values $V_{max}$. Even in such the case, a judgment can be made that there is no nozzle clogging, thereby enabling to improve ink droplet landing accuracy and the detection speed, and to properly perform the maintenance operation only in the case when the maintenance operation is needed.

Accordingly, the landing of in droplets can be detected by using a vibration detection portion (for example, piezo film) with high accuracy, and nozzle clogging can be detected with easy structure. This results in a decrease of the cost for the apparatus.

The entire disclosure of Japanese Patent Application Nos. Tokugan 2004-119017 which was filed on Apr. 14, 2004, and Tokugan 2004-313732 which was filed on Oct. 28, 2004, including specification, claims, drawings and summary are incorporated herein by reference in its entirety.

What is claimed is:

1. An ink jet printer to record an image on a recording medium by jetting ink from nozzles comprising:

a vibration detection section to receive ink jetted from the nozzles and output a detection signal having an amplitude corresponding to a vibration generated when the ink lands on the vibration detection section;

a sampling section to sample an amplitude value of the detection signal by a predetermined sampling clock signal;

a storing section to store an amplitude value data of the detection signal sampled by the sampling section;

a judging section to judge a jet failure of one of the nozzles based on the amplitude value data of the detection signal stored in the storing section; and a control section to control to jet the ink continuously a plurality of times with a jet drive cycle which is set by multiplying a standard drive waveform time of an ink jet signal from the nozzles by an odd number which is not less than five when detecting a jet failure of one of the nozzles.

2. The printer of claim 1, wherein the jet drive cycle is set by multiplying the standard drive waveform time of the ink jet signal by an integral number which is one of five, seven, nine, eleven, thirteen and fifteen.

3. The printer of claim 1, wherein the sampling section comprises a sampling time period having a predetermined time slot from a time which is delayed by a time it takes for the ink to land on the detection section from a generation time of the ink jet signal for jetting the ink.

4. The printer of claim 1, wherein the storing section stores the amplitude value data in a memory map comprising addresses which are based on the number of ink droplet jetting operations from the nozzles and a clock number of the sampling clock number.

5. The printer of claim 1, wherein the judging section reads out an address of the amplitude value data showing a maximum amplitude value in each ink droplet jetting operation from the nozzles, and judges the jet failure of one of the nozzles based on the number of address which was read out.

6. The printer of claim 5, wherein the judging section compares a value in the amplitude value data corresponding to the address which was read out with a preset standard value, and judges that the jet failure exists when the value in the amplitude value data is lower than the preset standard value.

7. The printer of claim 1, further comprising a maintenance section for solving a jet failure of one of the nozzles.

8. The printer of claim 7, wherein the maintenance section solves the jet failure of one of the nozzles by a suction operation or a flashing operation.

9. An ink jet printer to record an image on a recording medium by jetting ink from nozzles comprising:

a vibration detection section to receive ink jetted from the nozzles and output a detection signal having an amplitude corresponding to a vibration generated when the ink lands the vibration detection section;

a sampling section to sample an amplitude value of the detection signal by a predetermined sampling clock signal;

a storing section to store an amplitude value data of the detection signal sampled by the sampling section;

a judging section to judge a jet failure of one of the nozzles based on the amplitude value data of the detection signal stored in the storing section; and a control section to control to jet the ink continuously n times with a predetermined jet drive cycle from the nozzles when detecting a jet failure of one of the nozzles, wherein the judging section judges the jet failure of one of the nozzles based on only a control for jetting the ink from n/2 times in a control for jetting the ink continuously n times, and the n is an integer which is not less than two.

10. The printer of claim 9, wherein the predetermined jet drive cycle is set by multiplying a standard drive waveform time of an ink jet signal by an odd number which is not less than five.

11. The printer of claim 10, wherein the jet drive signal cycle is set by multiplying the standard drive waveform time of the ink jet signal by an integral number which is one of five, seven, nine, eleven, thirteen and fifteen.

12. The printer of claim 9, wherein the sampling section comprises a sampling time period having a predetermined time slot from a time which is delayed by a time it takes for the ink to land on the detection section from a generation time of the ink jet signal for jetting the ink.

13. The printer of claim 9, wherein the storing section stores the amplitude value data in a memory map comprising addresses which are based on the number of ink droplet jetting operations from the nozzles and a clock number of the sampling clock number.

14. The printer of claim 9, wherein the judging section reads out an address of the amplitude value data showing a maximum amplitude value in each ink droplet jetting operation from the nozzles, and judges the jet failure of one of the nozzles based on the number of address which was read out.

15. The printer of claim 14, wherein the judging section compares a value of the amplitude value data corresponding to the address which was read out with a preset standard value, and judges that the jet failure exists when the value of the amplitude value data is lower than the preset standard value.

16. The printer of claim 9, further comprising a maintenance section for solving a jet failure of one of the nozzles.

17. The printer of claim 16, wherein the maintenance section solves the jet failure of one of the nozzles by a suction operation or a flashing operation.

* * * * *